United States Patent [19]

Quenneville

[11] Patent Number: 4,510,900

[45] Date of Patent: Apr. 16, 1985

[54] HYDRAULIC PULSE ENGINE RETARDER

[75] Inventor: Raymond N. Quenneville, Suffield, Conn.

[73] Assignee: The Jacobs Manufacturing Company, Bloomfield, Conn.

[21] Appl. No.: 629,101

[22] Filed: Jul. 9, 1984

Related U.S. Application Data

[63] Continuation-in-part of Ser. No. 448,350, Dec. 9, 1982, abandoned.

[51] Int. Cl.[3] ..... F02D 31/00

[52] U.S. Cl. ..... 123/321; 123/90.12; 123/198 F

[58] Field of Search ..... 123/321, 322, 329, 198 F, 123/90.12, 90.13

[56] References Cited

U.S. PATENT DOCUMENTS

| | | | |
|---|---|---|---|
| 2,635,544 | 4/1953 | Lossau | 123/90.13 |
| 3,220,392 | 11/1965 | Cummings | 123/321 |
| 3,306,270 | 2/1967 | McCarl | 123/90.12 |
| 3,367,312 | 2/1968 | Jonsson | 123/321 |
| 3,405,699 | 10/1968 | Caas | 123/320 |
| 3,547,087 | 12/1970 | Siegler | 123/321 |
| 3,786,792 | 1/1974 | Pelizzoni et al. | 123/90.16 |
| 3,809,033 | 5/1974 | Cartledge | 123/90.46 |
| 3,859,970 | 1/1975 | Dreisin | 123/90.12 |
| 4,054,156 | 10/1977 | Benson | 123/229 |
| 4,150,640 | 4/1979 | Egan | 123/90.12 |
| 4,271,796 | 6/1981 | Sickler et al. | 123/321 |

*Primary Examiner*—William A. Cuchlinski, Jr.
*Attorney, Agent, or Firm*—Donald E. Degling

[57] ABSTRACT

A compression release engine retarder for a multicylinder four-stroke cycle engine is disclosed. The retarder incorporates an hydraulic pulse generator including a multichamber positive displacement pump of the piston and cylinder or gear pump type which is positively driven at engine speed or at half engine speed in synchronism with the engine crank shaft. Means are provided to adjust the timing of the hydraulic pulses so as to control precisely the opening of the engine exhaust valves and to maximize the compression release retarding power developed by the engine. Additional means are provided to control the timing of the hydraulic pulses in response to the boost pressure in the engine inlet manifold produced by the engine turbocharger.

15 Claims, 18 Drawing Figures

HYDRAULIC PULSE ENGINE RETARDER

BACKGROUND OF THE INVENTION

This application is a continuation-in-part of application Ser. No. 448,350, filed Dec. 9, 1982 now abandoned.

FIELD OF THE INVENTION

This invention relates generally to an improved engine retarding system of the compression release type. More particularly, the invention relates to an hydraulic pulse generating system adapted to open sequentially the exhaust valves of an internal combustion engine so as to provide a compression release engine retarding function.

THE PRIOR ART

The problem of providing adequate and reliable braking for vehicles, particularly large tractor trailer vehicles is well known. When such vehicles are operating at normal highway speeds they possess a very large momentum, and this may be increased substantially when the vehicle is required to negotiate a long decline. While the normal drum or disc type wheel brakes are capable of absorbing a large amount of energy over a short period of time, the absorbed energy is transformed into heat which rapidly raises the temperature of the braking mechanism to a level which may render ineffective the friction surfaces and other parts of the mechanism. As repeated use of the wheel brakes under these conditions is impracticable, resort has been made to auxiliary retarding devices.

Such auxiliary devices include hydraulic or electrodynamic retarding systems wherein the kinetic energy of the vehicle is transformed by fluid friction or magnetic eddy currents into heat which may be dissipated through appropriate heat exchangers. Other auxiliary retarding systems include exhaust brakes which inhibit the flow of exhaust gases or air through the exhaust system and compression release retarder mechanisms wherein the energy required to compress the intake air during the compression stroke of a four cycle engine is dissipated by exhausting the compressed air through the exhaust system during the expansion stroke of the engine. With respect to the engine compression release retarder, a portion of the kinetic energy of the vehicle is dissipated through the engine cooling system while another portion of the kinetic energy is dissipated through the engine exhaust system. With the exhaust brake, the kinetic energy of the vehicle is dissipated only as heat through the engine cooling system.

One principal advantage of the engine compression release retarder and the exhaust brake over the hydraulic and electrodynamic retarders is that both of the latter retarders require dynamos or turbine equipment which may be bulky and expensive in comparison with the mechanism required for the usual exhaust brake or engine compression release retarder. A typical engine compression release retarder is shown in the Cummins U.S. Pat. No. 3,220,392 while an exhaust brake is disclosed in Benson U.S. Pat. No. 4,054,156. Other mechanisms which produce compression release braking are disclosed in Cartledge U.S. Pat. No. 3,809,033, Pelizzoni et al. U.S. Pat. No. 3,786,792, Siegler U.S. Pat. No. 3,547,087, Dreisin U.S. Pat. No. 3,859,970 and Jonsson U.S. Pat. No. 3,367,312.

Another advantage of the engine compression release retarder such as that shown in the Cummins U.S. Pat. No. 3,220,392 is that it employs the existing valve train mechanism and requires only the addition of a master piston and a slave piston for each cylinder together with an appropriate control system. However, by using engine valve or fuel injector pushtubes as a source of motion, the Cummins type compression release retarder may introduce forces into the valve train mechanism which are different from, and perhaps more severe than, the forces contemplated in the original engine design. Moreover, the timing of the compression release event is necessarily determined by a valve event occurring elsewhere in the engine, which valve event may not be optimum with respect to the retarding function.

One approach to the problem of excess stress in the valve train mechanism is shown in Sickler et al. U.S. Pat. No. 4,271,796 wherein a pressure relief device is incorporated into the hydraulic system to limit the maximum pressure which may be produced therein. A simple relief valve for the hydraulic system is disclosed in Egan U.S. Pat. No. 4,150,640. Similarly, the problem of timing has been addressed in Custer U.S. Pat. No. 4,398,510, wherein means are disclosed automatically to vary the clearance in the valve train mechanism upon actuation of the compression release retarder. Decreasing the clearance in the valve train mechanism advances the opening of the exhaust valve during compression release retarding and thereby increases the retarding horsepower developed by the engine.

SUMMARY OF THE INVENTION

Applicants have discovered that improved engine retarding and complete avoidance of the risk of damaging the valve train of the engine can be attained by the use of hydraulic pulses produced by an hydraulic pulse generator driven by or from the engine cam shaft or by an auxiliary drive. The hydraulic pulse generator preferably is driven by a shaft revolving at the speed of the engine and designed to produce an hydraulic pulse timed to coincide with the beginning of the expansion or power stroke of each cylinder of the four cycle engine. Alternatively, the pulse generator may be driven by a shaft operating at half of the engine speed. Timing may be adjustable over a broad range by changing the position of the pulse generator and its driving shaft relative to the engine crankshaft while the magnitude of the pulse may be determined by the design of the pulse generator. In addition, timing may be adjusted as a function of the boost pressure to control more precisely the compression release event.

DESCRIPTION OF THE DRAWINGS

Further objects and advantages of the invention will become apparent from the following detailed description of the invention and the accompanying drawings in which.

DETAILED DESCRIPTION OF THE INVENTION

The basic operation of the compression release engine retarder is now well-known in the art and need not be set forth in detail here. Briefly, however, the compression release retarder employs the motion of an element in the valve train or fuel injection train, typically a push tube, which has close to the desired timing, and uses this motion to drive a master piston. The master piston is hydraulically interconnected with a slave piston which acts to open an exhaust valve (or dual exhaust valves) at or near the beginning of the expansion or "power" stroke of a four cycle engine. When the compression release engine retarder is in operation, the fuel supply is automatically shut off so that the engine is pumping air only. By opening the exhaust valves at the beginning of the expansion or "power" stroke of the engine, the work done in compressing air during the compression stroke is not recovered during the expansion stroke, but, instead, is dissipated through the engine exhaust and cooling systems.

The energy so absorbed by the engine can be measured by an electric dynamometer in terms of the retarding horsepower developed by the engine. The total retarding effect includes, of course, the energy loss represented by the internal friction of the engine and all other losses related to the engine auxiliaries. The absolute value of the retarding horsepower developed during compression release retarding can be a substantial portion of the positive horsepower developed by the engine during normal fueling operation.

Figure 1:
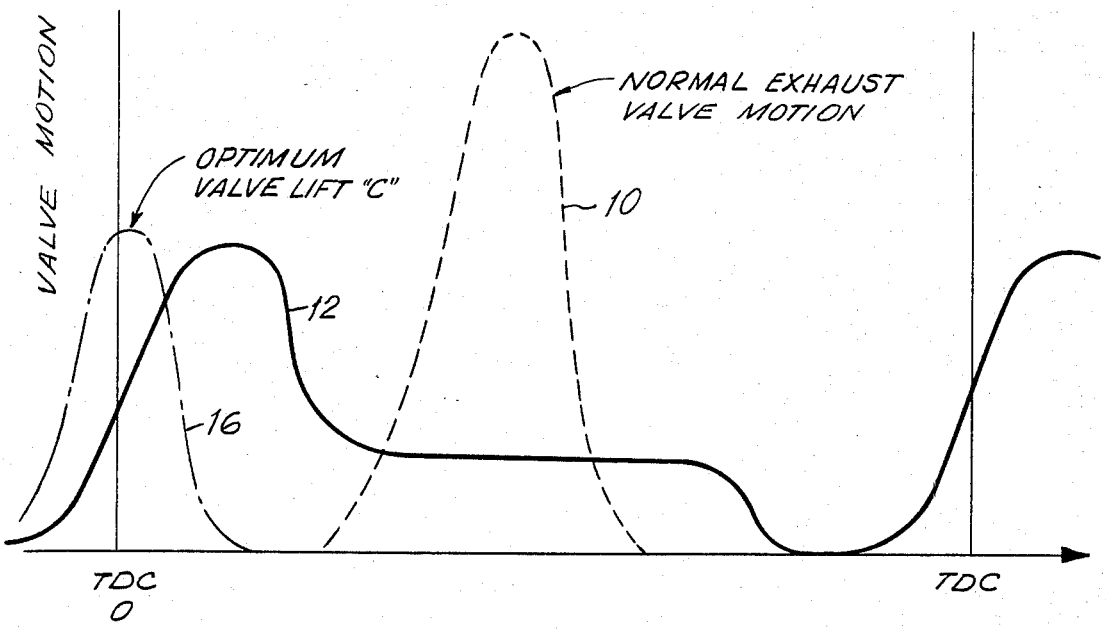
FIG. 1 is a diagram of the exhaust valve motion under various modes of engine operation.

Reference is now made to FIG. 1 which shows various exhaust valve motions. In FIG. 1, exhaust valve motion is plotted as the ordinate while crank angle, starting at top dead center (TDC), is the abscissa. Curve 10 indicates the normal mode of operation of the exhaust valve at the beginning of the exhaust stroke of the engine. Curve 12 illustrates a typical exhaust valve motion of an engine equipped with a compression release brake designed to open the exhaust valves at the beginning of the expansion stroke of the engine as close to top dead center as may be practicable. More specifically, curve 12 shows the motion of the exhaust valve imparted by the fuel injector pushtube. The motion shown by curve 12 may be produced by the device described, for example, in Sickler et al. U.S. Pat. No. 4,271,796 referred to above. Curve 16 indicates the desired optimum motion of the exhaust valve to maximize the dissipation of the power stored in the engine during the compression stroke. It will be appreciated that the precise timing of the compression release exhaust valve opening should be selected so as to maximize the work of compression and minimize the recovery of that work during the ensuing expansion stroke. This implies a rapid opening of the valve near the end of the compression stroke and close to the top dead center position. However, where the valve operating motion is derived from another part of the engine, such as the fuel injector pushtube or the exhaust pushtube for another cylinder, it may be impossible to attain an optimum operation of the compression release mechanism.

Figure 2A:
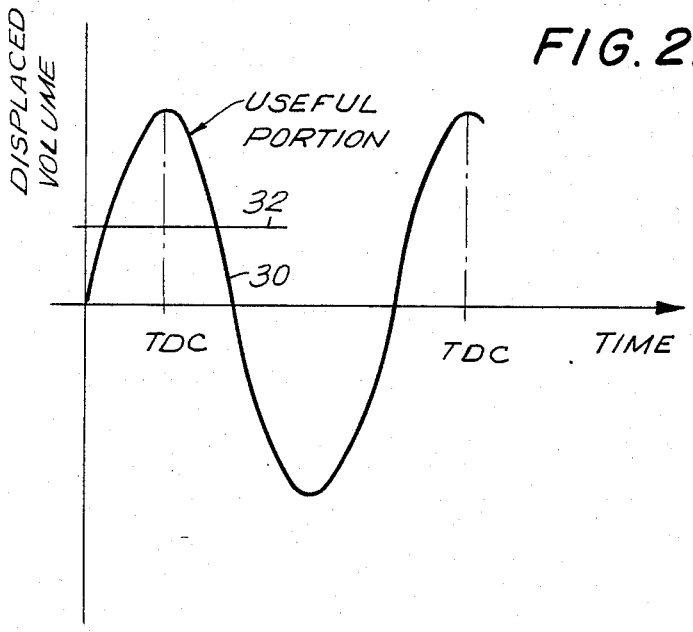
FIG. 2(A) is a diagram showing the displacement of a positive displacement pulse generator as a function of time.
Figure 2B:
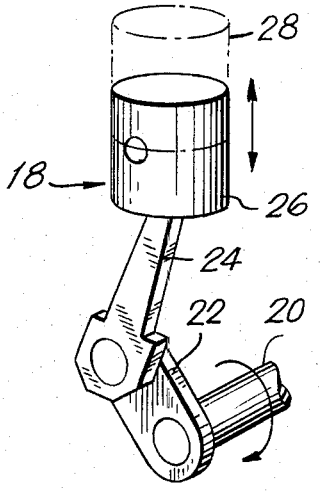
FIG. 2(B) is a schematic view of a positive displacement pulse generator in the form of a crank driven piston and cylinder.

FIG. 2(A) is a schematic plot of volume vs. time for a positive displacement pulse generator such as the piston pump 18 of FIG. 2(B). Pump 18 comprises a shaft 20 which drives a crank 22 which, in turn, drives a connecting rod 24 affixed to a piston 26 constrained to move within a cylinder 28. It will be observed that the positive portion of the displacement curve 30 is similiar to the optimum valve lift curve 16 of FIG. 1. A portion of the displacement curve 30, such as that above the line 32, may, therefore, function as a valve-operating pulse, if properly timed.

Reference is now made to FIGS. 3A–3F which illustrate sequentially the operation of a compression release engine retarder using a three-unit pulse generator in accordance with the present invention. The engine block for a six-cylinder four-stroke cycle internal combustion engine is shown in fragmentary form at 34. Cylinder No. 1 is indicated at 36 and contains piston 38. Cylinder No. 6 is indicated at 40 and contains piston 42. In the particular engine illustrated, the pistons for Cylinder Nos. 1 and 6 reach top dead center (TDC) at the same time and move in tandem. However, when piston No. 1 (38) is moving upwards in an exhaust stroke, piston No. 6 (42) is moving upwards in a compression stroke. It will be understood that Cylinder Nos. 2 and 5 and Cylinder Nos. 3 and 4 are similarly paired. The operation of the present invention will be limited to a description of the sequential events related to Cylinder Nos. 1 and 6, it being understood that similar events will occur with the other cylinders but at a different time.

Intake valve 44 for Cylinder No. 1 (36) is normally biased toward a closed position by valve spring 46. Similarly intake valve 48 for Cylinder No. 6 (40) is biased toward the closed position by valve spring 50. The intake valves 44, 46 may be operated by rocker arms (not shown).

The exhaust valve 52 for Cylinder No. 1 (36) is biased toward its closed position by valve spring 54. Exhaust valve 52 is opened during the fueling mode of engine operation by rocker arm 56 driven by the engine cam shaft (not shown) and acts through a crosshead 58. A slave piston 60 is mounted for reciprocating motion in a slave piston cylinder 62 formed in a housing 64 secured to the engine head 63 which is, in turn, secured to the engine block 34. The slave piston 60 is biased away from the crosshead 58 by a spring 65.

Similarly, exhaust valve 66 for Cylinder No. 6 (40) is biased toward its closed position by valve spring 68. Exhaust valve 66 is opened during the fueling mode by rocker arm 70 which acts through crosshead 72. Slave piston 74 is mounted for reciprocating motion in slave piston cylinder 76 formed in the housing 64. The slave piston 74 is biased away from the crosshead 72 by a spring 78.

A duct 80 communicates between the slave piston cylinders 62, 76 and the master cylinder 82 formed in housing 84 of pulse generator 85. Master cylinder 82 is disposed in the housing 84 radially with respect to pulse generator drive shaft 86 which may be any engine accessory or auxiliary drive shaft operating at engine speed and positively driven directly or indirectly from the engine crank shaft so as to maintain synchronism therewith. Master cylinders 88 and 90 are also disposed radially with respect to the drive shaft 86 and separated from each other and master cylinder 82 by 120° of arc. A duct 92 leads from master cylinder 88 to a pair of slave piston cylinders (not shown) identical to slave piston cylinders 62 and 76 but associated with engine Cylinder Nos. 2 and 5. Similarly, a duct 94 leads from master cylinder 90 to a third pair of slave piston cylinders (not shown) identical to slave piston cylinders 62 and 76 but associated with engine Cylinder Nos. 3 and 4. An eccentric 96 is keyed to the drive shaft 86 which, as shown in FIGS. 3A–3F, is driven in a counterclockwise direction. It will be understood that rotation of the drive shaft 86 drives the eccentric 96 against a ring 97 which contacts master pistons 98, 100 and 102 respectively mounted for reciprocating motion in master cylinders 82, 88, and 90 thereby causing the pistons sequentially to move radially outwardly from the drive shaft 86. The motion imparted to the master pistons 98, 100 and 102 by the eccentric 96 is functionally equivalent to the motion produced by the schematic slider crank mechanism shown in FIGS. 2A and 2B. Further details related to the structure of the pulse generator 85 will be set forth below in connection with a discussion of FIGS. 4 and 5.

Figure 3A:
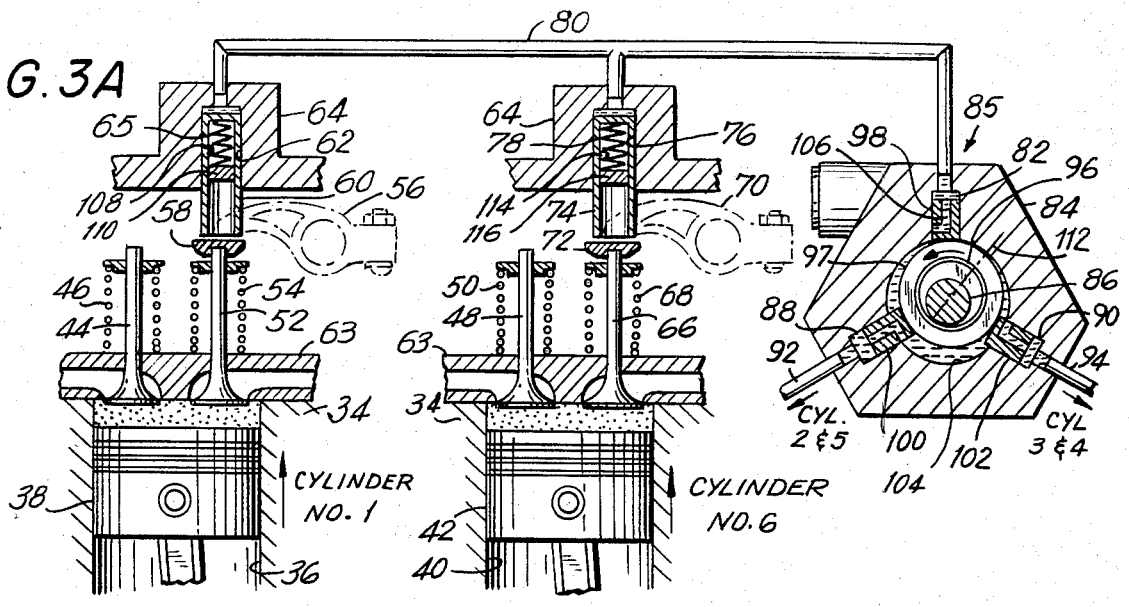
FIG. 3(A) shows a diagrammatic layout of a compression release engine retarder having a three-unit pulse generator operating at engine speed, each unit adapted alternately to open the exhaust valves of two cylinders of a six cylinder engine at the beginning of the braking event on Cylinder No. 6.

Referring now to FIG. 3A, piston 38 of Cylinder No. 1 is beginning to move upwardly on an exhaust stroke while piston 42 of Cylinder No. 6 is beginning to move upwardly on a compression stroke. The ring 97 driven by the eccentric 96 is also beginning to move the master piston 98 in a radially outward direction. At this point the exhaust valves 52 and 66 are still closed but the master piston 98 has moved sufficiently to isolate duct 80 and the hydraulic fluid contained therein from the low pressure hydraulic fluid supply within the eccentric chamber 104 of the pulse generator. This is shown schematically in FIG. 3A in that the L-shaped passageway 106 within the master piston 98 which communicates between the duct 80 and eccentric chamber 104 when the master piston 98 is in a radially inward position is now out of communication with the eccentric chamber 104.

Figure 3B:
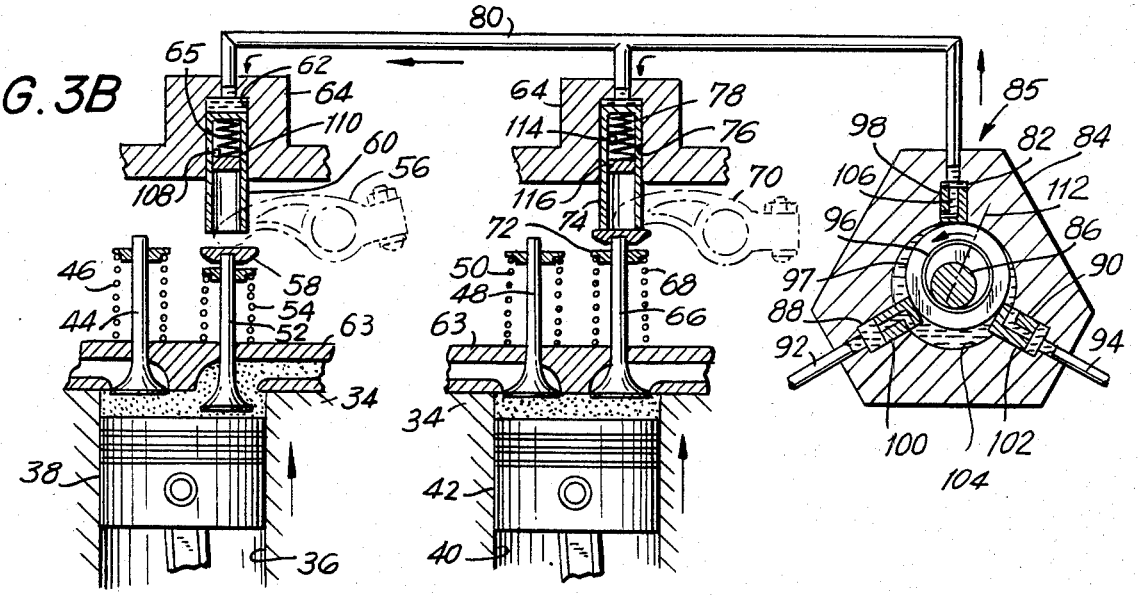
FIG. 3(B) shows the mechanism of FIG. 3(A) at an early stage in the pulse when the slave piston of Cylinder No. 1 has seated against a stop.

FIG. 3B shows the compression release mechanism at a point slightly later in time when the rocker arm 56 has opened exhaust valve 52 in a normal valve opening sequence as required in conjunction with the normal exhaust stroke of Cylinder No. 1 (36). When the exhaust valve 52 and its crosshead 58 are displaced downwardly, the motion of the slave piston 60 is restrained only by the bias of the spring 65. Consequently, as the pressure in the duct 80 builds up from the radially outward motion of the master piston 98, hydraulic fluid enters the slave cylinder 62 and drives the slave piston 60 downwardly until an abutment 108 on the slave piston 60 strikes a stop 110 mounted on the housing 64. It will be appreciated that the motion of slave piston 60 which occurs while the hydraulic fluid in duct 80 is still at a relatively low pressure has no effect on the exhaust valve 52 which, during this interval, is controlled by rocker arm 56. As soon as the pressure in duct 80 is high enough to overcome the bias of spring 65 in slave piston cylinder 62 it will also overcome the bias of spring 78 in slave piston cylinder 76 and bring the slave piston 74 into contact with crosshead 72, thereby taking up the lash or clearance normally existing between each slave piston and its associated exhaust valve crosshead whenever the duct 80 is in communication with the low pressure existing in the eccentric chamber 104. However, slave piston 74 will not open exhaust valve 66 at this time because the force required to open valve 66 greatly exceeds that required to move the slave piston 74 against the bias of spring 78 and therefore only the latter motion will occur.

Figure 3C:
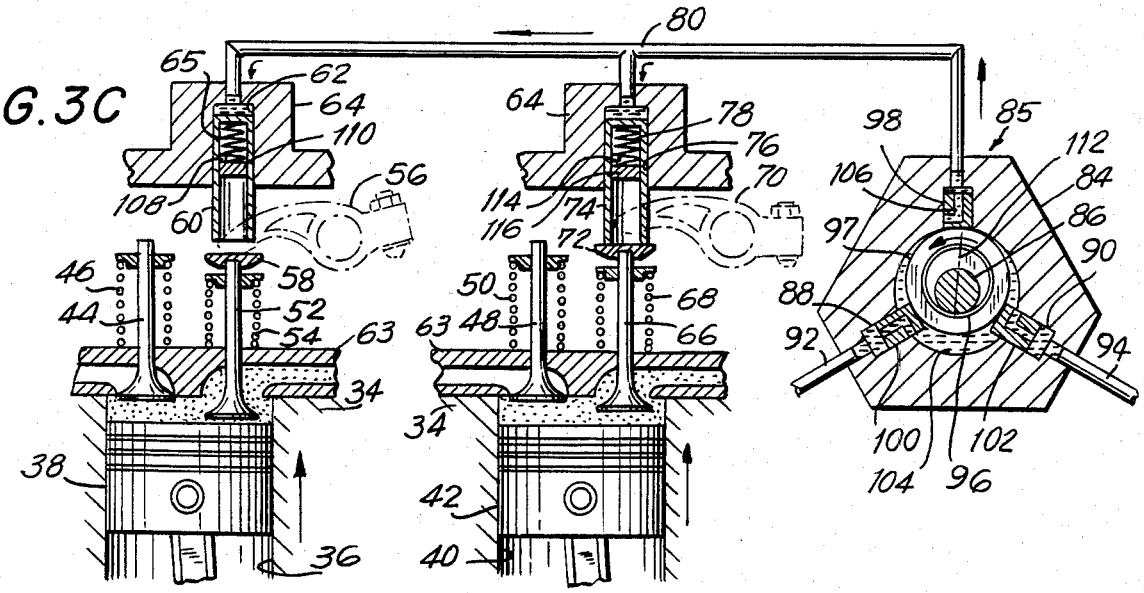
FIG. 3(C) shows the mechanism of FIG. 3(A) at the maximum pulse pressure when the slave piston for Cylinder No. 6 has opened the exhaust valve of Cylinder No. 6.

FIG. 3C shows the compression release mechanism when the master piston 98 has attained its maximum stroke. At this time, the hydraulic pressure in the duct 80 has reached a high level and is sufficient to overcome the bias of valve spring 68 and the forces on valve 66 due to the air compressed in Cylinder No. 6 (40) so as to open exhaust valve 66. It will be appreciated that movement of the master piston 98 should be controlled by the position of the eccentric 96 so that the exhaust valve 66 is opened close to the TDC position of the piston 42 in order to maximize the retarding horsepower developed by the engine. This insures that the maximum amount of work has been done in compressing air during the compression stroke and that the minimum portion of that work is recovered during the ensuing expansion stroke.

Figure 3D:
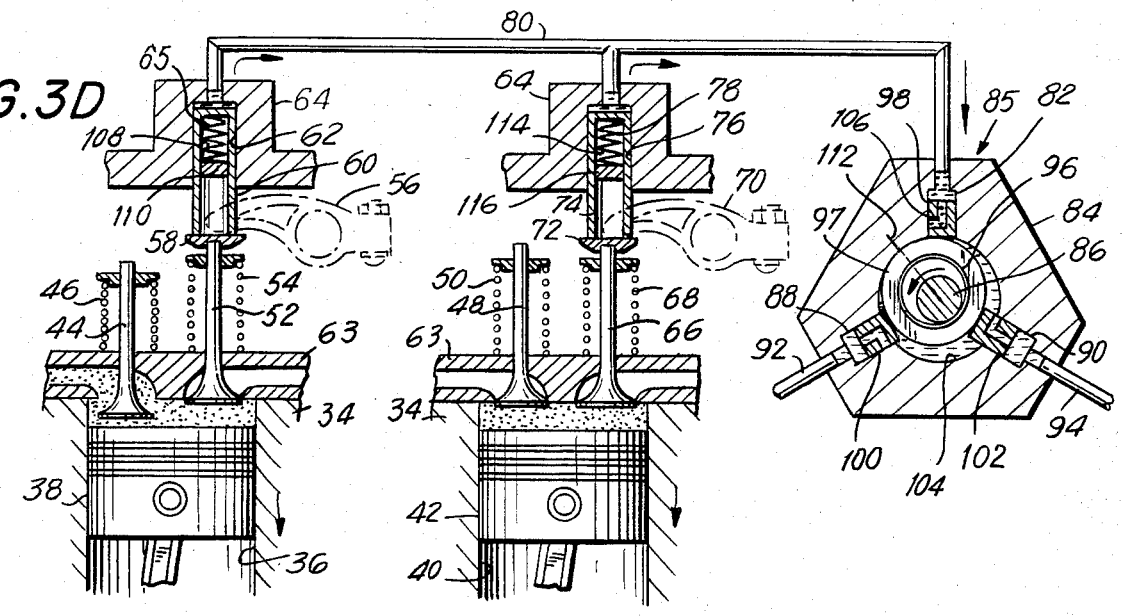
FIG. 3(D) shows the mechanism of 3(A) when the pulse has been completed and the slave pistons for Cylinder Nos. 1 and 6 have been returned to the reset position.

FIG. 3D illustrates a subsequent condition of the mechanism in which the eccentric 96 has moved to a point where the master piston 98 has retracted to essentially the position it had in FIG. 3B. As a result of the retraction of the master piston 98, the pressure in the slave cylinder 76 drops to a point where the valve spring 68 will close the valve 66. In the meantime rocker arm 56 oscillates back to its original position and valve spring 54 closes exhaust valve 52. As exhaust valve 52 closes, slave piston 60 is driven upwardly. As shown by the arcuate movement of the dashed line 112 between FIGS. 3A and 3D it will be apparent that shaft 86 has moved through an angle of slightly less than 90°. During the next approximately 30° of drive shaft movement the master piston 98 will be retracted so that duct 80 communicates through L-shaped passageway 106 with the eccentric chamber 104 thereby equalizing the pressure in duct 80 and in the eccentric chamber 104. Under these conditions the bias of the springs 65 and 78 is sufficient to drive the slave pistons 60 and 74 respectively away from the crossheads 58 and 72. It will be apparent from the position of the dashed line 112 in FIG. 3D that continued crank shaft rotation, i.e., rotation of the pulse generator drive shaft 86, will cause the eccentric 96 to drive master piston 100 radially outward and thus initiate a cycle of everts in Cylinder Nos. 2 and 5 similiar to those described bove with respect to Cylinder Nos. 1 and 6. Continued rotation of the pulse generator drive shaft 86 will then cause a repeat of these cyclic actions with respect to Cylinder Nos. 3 and 4 as a result of the motion of master piston 102.

Figure 3E:
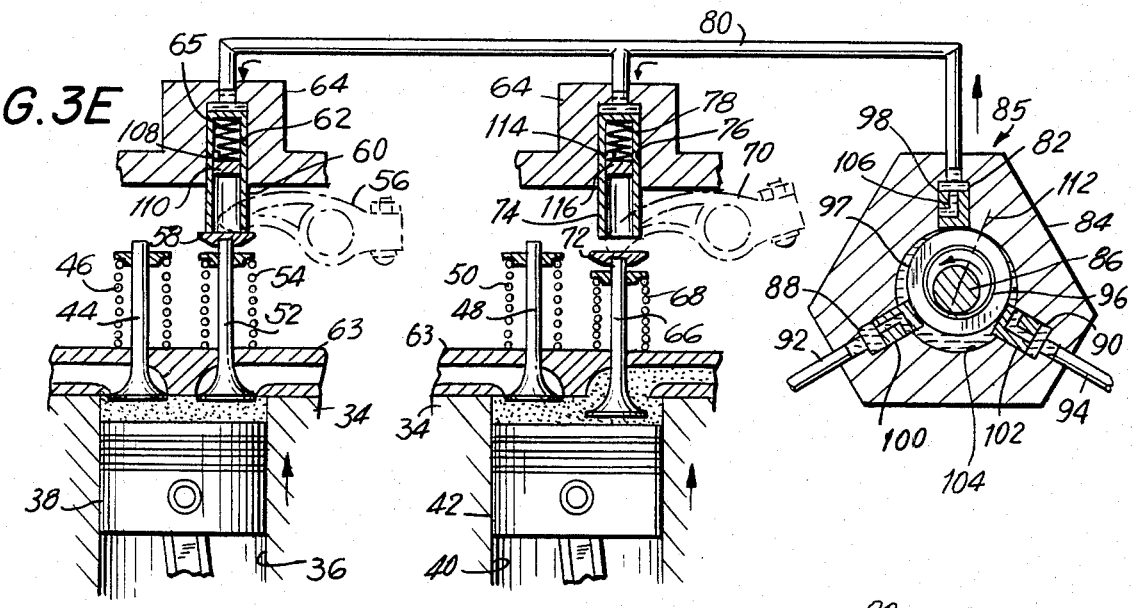
FIG. 3(E) shows the mechanism of 3(A) at an early stage in the ensuing pulse for Cylinder Nos. 1 and 6 when the slave piston for Cylinder No. 6 has seated against a stop.

FIG. 3E shows the condition of the compression release mechanism when the eccentric 96 has again reached master piston 98. At this point Cylinder No. 6 (40) is beginning its exhaust stroke while Cylinder No. 1 (36) is beginning its compression stroke. Under these conditions, rocker arm 70 oscillates downwardly against the crosshead 72 to open exhaust valve 66. Thereafter, as the pressure in duct 80 begins to build, hydraulic fluid enters the slave cylinder 76 and drives slave piston 74 downwardly until the abutment 114 in slave piston 74 strikes stop 116 mounted on the housing 64. As described above hydraulic fluid will also enter slave cylinder 62 driving slave piston 60 downwardly until it contacts the crosshead 58.

Figure 3F:
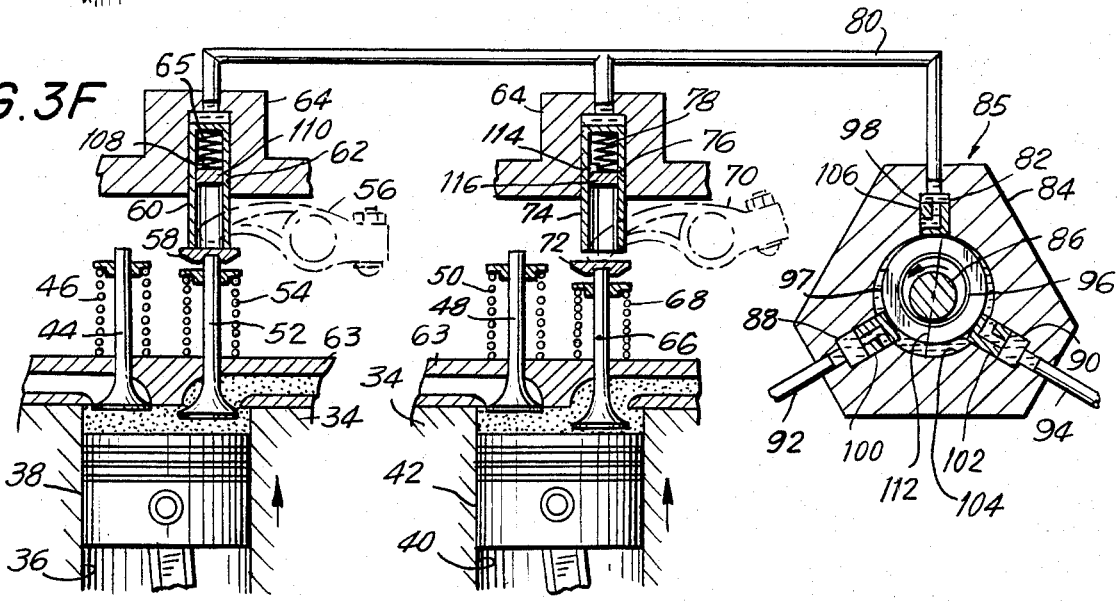
FIG. 3(F) shows the mechanism of FIG. 3(A) at the maximum pulse pressure when the slave piston for Cylinder No. 1 has opened the exhaust valve for Cylinder No. 1.

FIG. 3F corresponds essentially with FIG. 3C described above and represents the point at which the master piston 98 has moved to its extreme outward position and has raised the pressure in duct 80 to a point where slave piston 60 opens exhaust valve 52. Again, this occurs close to top dead center (TDC) position. Continued rotation of the pulse generator drive shaft 86 results in a decrease in the pressure in duct 80 which allows the exhaust valve 52 to close and ultimately slave pistons 60 and 74 will return to their respective rest positions. This sequence of operations is repeated for Cylinders Nos. 2 and 5 and again repeated for Cylinder Nos. 3 and 4.

It will be understood that in two rotations of the pulse generator drive shaft 86, which correspond to two rotations of the engine crank shaft, each of the engine cylinders will have experienced a compression release event close to the top dead center position of the piston near the end of the compression stroke.

Figure 4B:
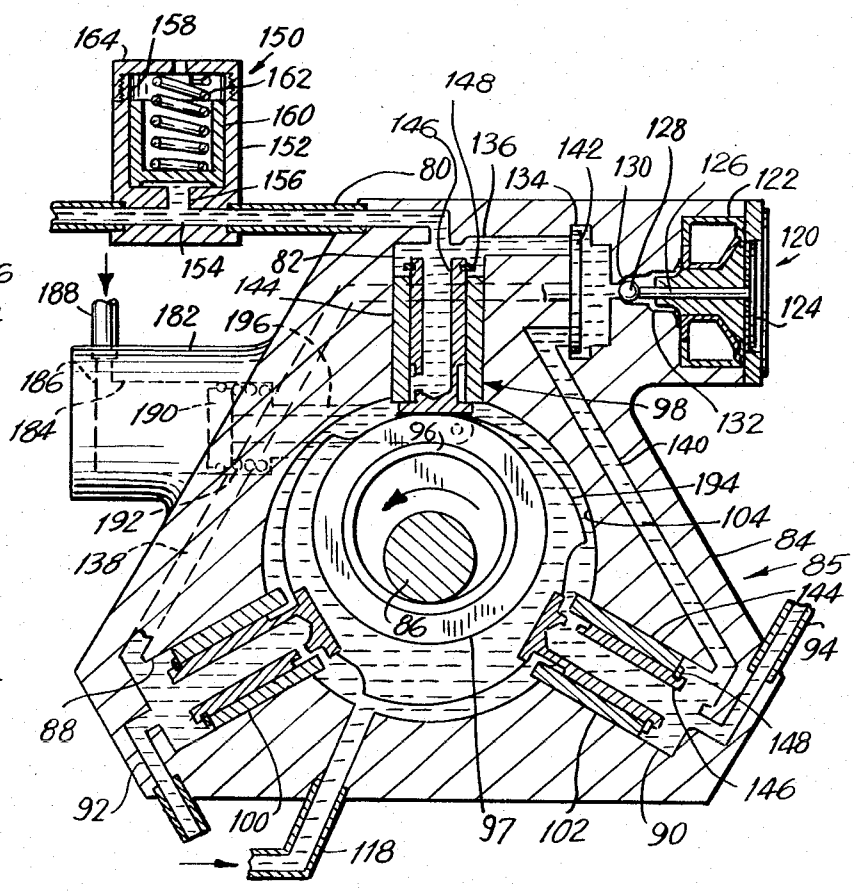
FIG. 4(B) is an enlarged view of the pulse generator showing the solenoid in an energized position and the timing advance mechanism at a high boost position.
Figure 4A:
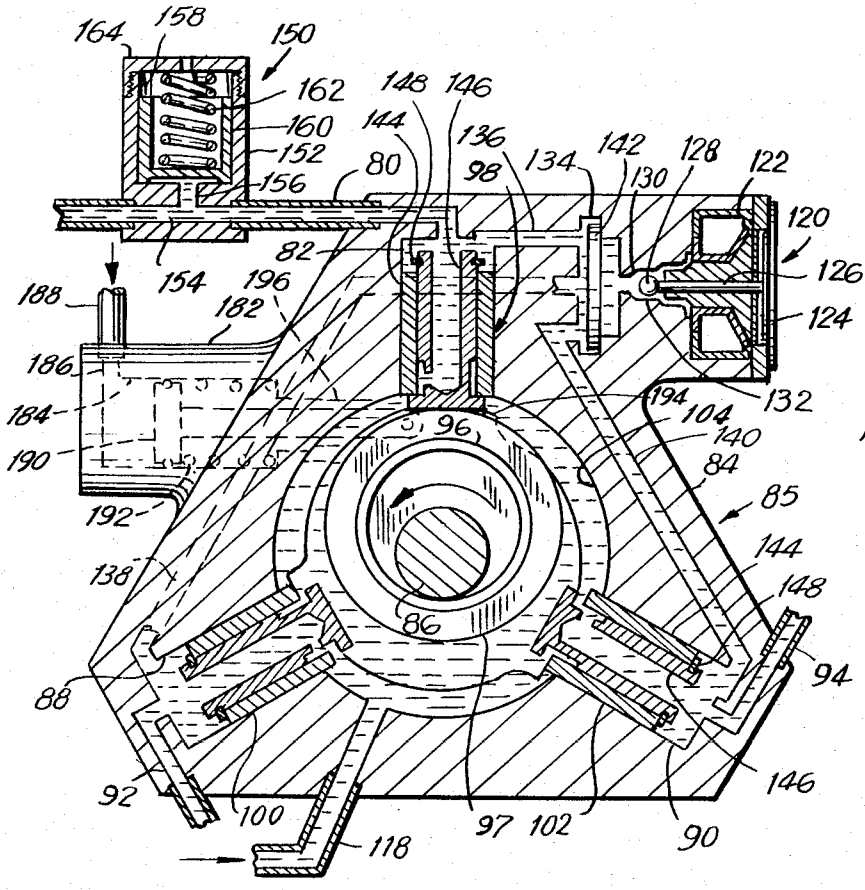
FIG. 4(A) is an enlarged view of the pulse generator showing additional details of its construction with the solenoid in a deenergized position and the timing advance mechanism at a low boost position.

Reference is now made to FIGS. 4A and 4B which show, on an enlarged scale, the pulse generator illustrated schematically in FIGS. 3A through 3F. FIGS. 4A and 4B also include a timing advance mechanism, a pressure relief mechanism, a solenoid switch to control the pulse generator and an alternative master piston construction. The pulse generator 85 comprises a housing 84 containing an eccentric chamber 104. Master cylinders 82, 88, and 90 are located radially 120° apart around the eccentric chamber 104. A duct 118 conducts low pressure hydraulic fluid, such as oil, to the eccentric chamber 104 and thence to the master cylinders 82, 88, and 90 the duct 80 and slave cylinders 62 and 76. Similarly, hydraulic fluid is conducted to the ducts 92 and 94 and their corresponding slave cylinders.

Operation of the pulse generator 85 is controlled by a solenoid valve 120 which comprises a solenoid coil 122, an armature disc 124, a control rod 126, and a ball valve 128 which seats on a valve seat 130. The ball chamber 132 communicates with a drain (not shown). Beyond the ball valve seat 130 is located a disc valve chamber 134. Passageways 136 138, 140 lead from the disc valve chamber 134 respectively to master cylinders 82, 88, 90. A disc valve 142 is moveably located within the disc valve chamber 134. When the solenoid valve 120 is deenergized, as shown in FIG. 4A, the armature disc 124 is released from the coil 122 and the control rod 126 and ball valve 128 move to the right (as shown in FIG. 4A) so as to permit hydraulic fluid from the disc valve chamber 134 to drain from the housing 85. This action causes the disc valve 142 to move to the right whereby the disc valve chamber 134 functions as a manifold with respect to the passageways 136, 138 and 140. It will be appreciated that when the disc valve 142 is open, the hydraulic fluid pumped sequentially by the master pistons 98, 100, 102 flows back to the eccentric chamber 104. It will be understood that when one master piston is pumping the other two master pistons (and their associated passageways) are draining.

When, however, the solenoid is energized (as shown in FIG. 4B), the solenoid ball valve 128 will be sealed to the seat 130 by the movement of the control rod 126 and the armature disc 124 and pressure will build up on the disc valve 142 so as to seal off the low pressure passageways. If, as shown in FIG. 4B, the eccentric 96 is driving master piston 98, then the high pressure from passageway 136 will cause the disc valve 142 to seal off the low pressure passageways 138 and 140. This will then permit the high pressure hydraulic fluid to enter duct 80 and perform the functions described above.

As shown in FIGS. 4A and 4B the master pistons 98, 100, 102 each comprise three parts: an outer cylindrical shell 144, an inner sliding piston 146, and a snap ring 148 which limits the relative sliding motion between the inner piston 146 and the cylindrical shell 144. It will be understood that the eccentric 96 and the ring 97 first drive he piston 146 into sealing engagement with the cylindrical shell 144 and then drive both parts of the piston 98 (or 100, 102) radially outward to provide the requisite hydraulic pressure in the duct 80 (or 92, 94).

FIGS. 4A and 4B also illustrate a pressure control mechanism 150 inserted into the duct 80. It will be understood, of course, that similar mechanisms may be placed in the corresponding duct 92 leading to Cylinders No. 2 and 5 and the duct 94 leading to Cylinder Nos. 3 and 4. The pressure control mechanism 150 comprises a housing 152 which contains a diametral passageway 154 communicating with the duct 80 and, communicating therewith, an axial passageway 156 which terminates in a cylindrical chamber 158. A piston 160 is mounted for reciprocating motion within the cylindrical chamber 158 of the housing 152 and is biased toward the axial passageway 156 by a relatively stiff spring 162. The spring 162 and piston 160 are held in place by a cap 164 which is threaded onto the housing 152.

In operation, the pressure control mechanism 150 functions as a sort of shock absorber to increase the volume of the hydraulic circuit whenever the pressure exceeds a predetermined level thereby limiting the maximum pressure that can be produced by the pulse generator mechanism 85. Those skilled in the art will appreciate that when a hydraulic circuit is relatively short the bulk modulus of the hydraulic fluid is such that the fluid may be regarded as essentially incompressible and some form of pressure control mechanism is desirable to relieve excess pressure in the system. However, when the hydraulic lines are relatively long the compressibility of the hydraulic fluid itself may be sufficient to provide, in effect, its own expansion chamber. In place of the pressure control mechanism described above, another device, such as a Bourdon-tube mechanism which expands with pressure, may be employed. In any event, whether or not a specific pressure control mechanism is employed, care should be taken to insure that the ducts 80, 92 and 94 are of approximately the same length and contain substantially the same quantity of hydraulic fluid in order that the action at each slave cylinder will be the same.

The pulse generator 85 may also incorporate a timing advance mechanism by which the timing of the hydraulic pulses may be varied as a function of the boost pressure developed by the engine turbocharger (if the engine is so equipped). It will be understood that the boost pressure in the inlet manifold of the engine varies with the speed of the turbocharger and that the mass of air introduced into the engine is also a function of the boost pressure. Moreover, the pressure developed in the engine cylinder during the compression stroke of the engine varies with the mass of air drawn into the cylinder on the intake stroke of the engine while the force required to open an exhaust valve is a function of the pressure in the engine cylinder with which that exhaust valve is associated.

Figure 6:
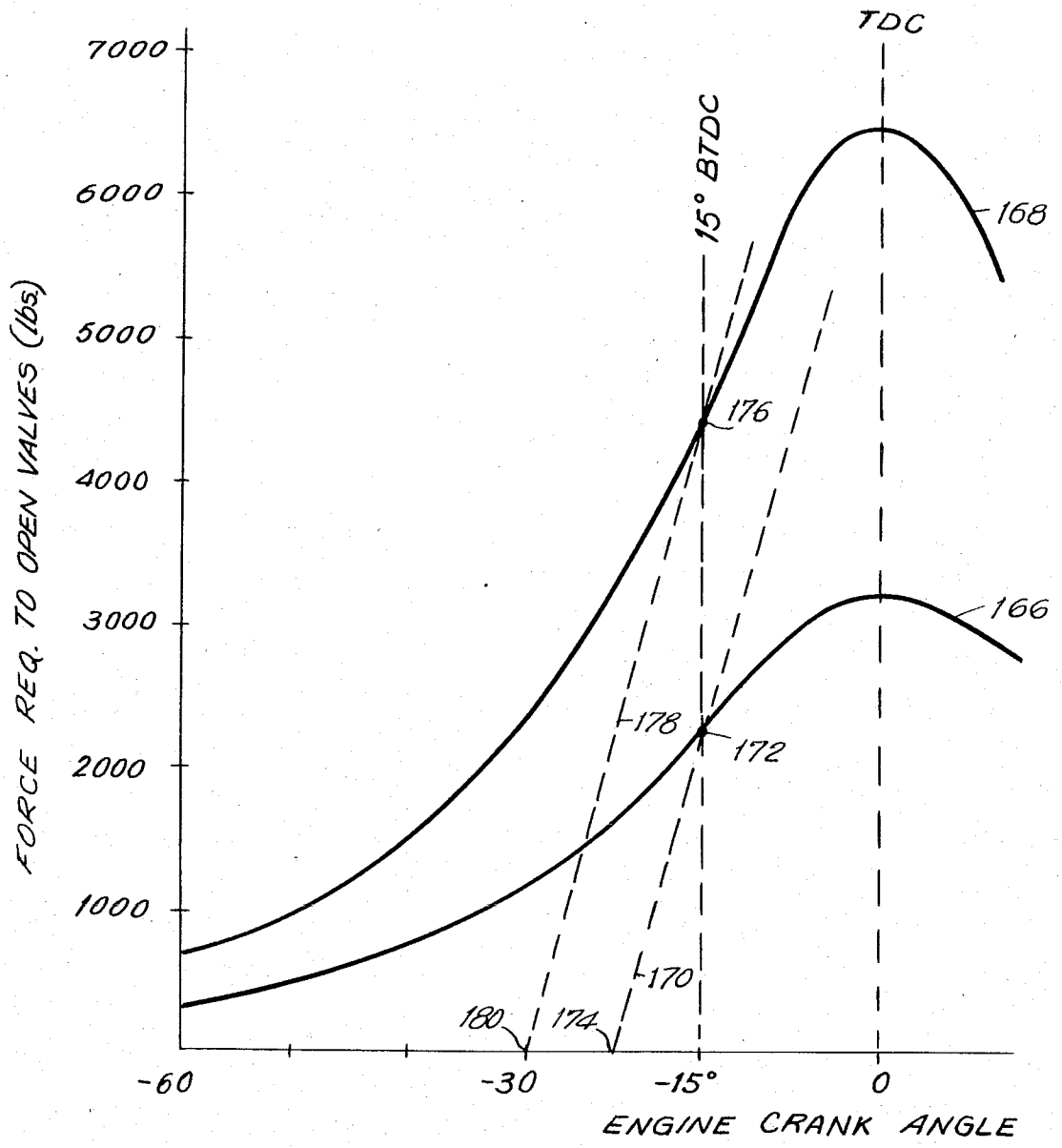
FIG. 6 is a family of curves showing the effect of turbocharger boost pressure on exhaust valve timing.

FIG. 6 is a family of curves in which the force required to open an engine exhaust valve is plotted as the ordinate against crank angle as the abscissa. Curve 166 shows how this force varies with the crank angle at low boost pressure while curve 168 is a similar curve for high boost pressure. It will be appreciated that an engine may operate at various boost pressures within the range represented by curves 166 and 168.

If it is desired to begin to open the exhaust valve at a particular point, e.g., 15° B.T.D.C., in order to maximize the compression release retarding effect, it, will be apparent that the initial movement of the master piston 98 (or 100, or 102) must precede such point. The slope of line 170 represents the rate at which the pressure in the hydraulic system, e.g., ducts 80, 92 and 94, builds up as a function of time (or crank angle) at low boost pressure so as to attain the force required to open the exhaust valve, indicated by point 172. The intersection of line 170 with the axis (point 174) establishes the crank angle at which motion of the master piston must begin in order to open the exhaust valve at point 172. Similarly point 176 on the high boost curve 168 indicates the force required to open the exhaust valve at 15° B.T.D.C. under high boost conditions. To attain this force, the pressure in the hydraulic system rises along curve 178 and intercepts the axis at point 180. From FIG. 6 it is apparent that a mechanism to adjust the timing of the master piston movement automatically in response to the boost pressure would be desirable.

Such a mechanism is included in FIGS. 4A and 4B. A boss 182, formed integrally with the housing 84, contains a cylindrical bore 184 which communicates at one end through a passageway 186 to a duct 188 which communicates with the engine intake manifold (not shown). The intake manifold is at all times subject to the boost pressure produced by the engine turbocharger (not shown). A piston 190 is disposed within the cylindrical bore 184 and is biased toward the passageway 186 by a spring 192. A three-lobed cam 194 is mounted on the drive shaft 86 so as to be rotatable independently from the eccentric 96 and the ring 97. The cam 194 is axially offset from the eccentric 96 so that each lobe of the cam 194 contacts the sliding cylindrical shell 144 of one of the pistons 98, 100 or 102 but does not contact the inner sliding piston 146. A link 196 interconnects the cam 194 and the piston 190.

At low boost pressure, the piston 190 is biased toward the left (as viewed in FIG. 4A) thereby rotating the cam 194 counterclockwise to a position where the cylindrical shells 144 of the pistons 98, 100 and 102 are driven radially outward from the drive shaft 86. As shown in FIG. 4B, at high boost pressure, the piston 190 is driven to the right and the cam 194 is rotated in a clockwise direction. Such rotation of the cam 194 allows the cylindrical shells 144 of the pistons 98, 100 and 102 to move radially inward toward the shaft 86. It will be appreciated that movement of the cylindrical shells 144 inwardly advances the motion of the master pistons 98, 100 and 102 relative to the drive shaft 86, the motion of which is in synchronism with the engine crank shaft. Thus, the timing of the motion of the master pistons is a function of boost pressure. The result of this is that the exhaust valves will be opened during a compression release retarding event at some point (e.g., 15° B.T.D.C.) regardless of changes which may occur in the boost pressure as a result, for example, of changes in the engine speed.

Figure 5:
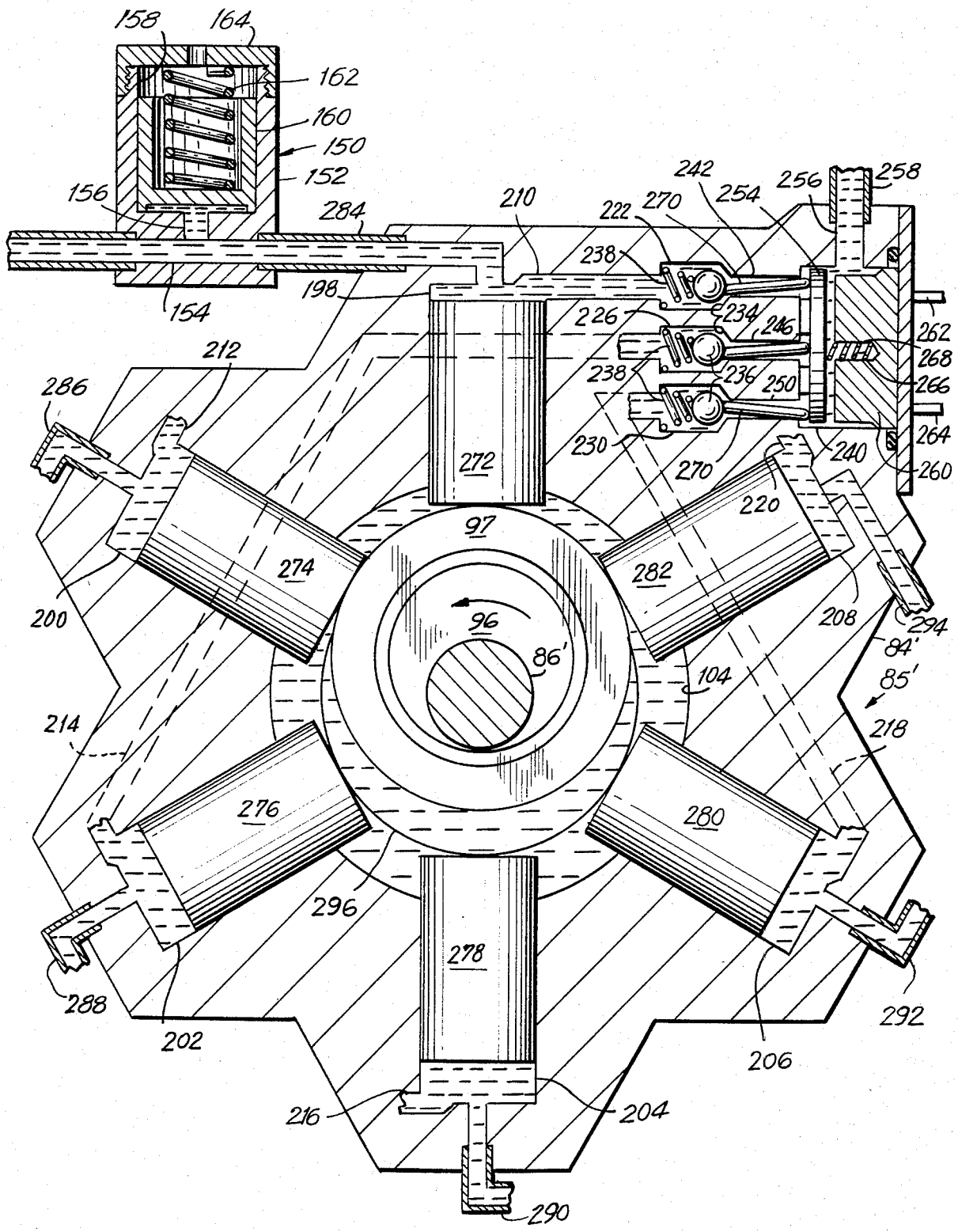
FIG. 5 is an enlarged view of an alternative form of a six-unit pulse generator designed to be driven at half engine speed and incorporating solid pistons, check valves, and an over-travel mechanism.

Reference is now made to FIG. 5 which illustrates an alternative form of the invention adapted or use in conjunction with a pulse generator drive shaft 86' which operate at half the speed of the engine crank shaft. In FIG. 5 parts which are common to FIGS. 3 and 4 are indicated by the same number while parts which are modified are designated by a prime (′). The housing 84' contains six master cylinders 198 200, 202, 204, 206 and 208 which, during compression release retarding, respectively control the opening of the exhaust valves for Cylinders Nos. 6, 2, 4, 1, 5 and 3. The master cylinders 198, 200, 202, 204, 206 and 208 are arranged in the same sequence as the firing order of the engine. Passageways 210, 212, 214, 216, 218 and 220 communicate respectively between master cylinders 198, 200, 202, 204, 206 and 208 and ball check valve chambers 222, 224, 226, 228, 230 and 232. Ball check valve chambers 224, 228 and 232 are behind chambers 222, 226 and 230, respectively, and thus are not visible in FIG. 5. Each ball check valve chamber is equipped with a seat 234, a ball check valve 236 and a spring 238 which normally biases the ball check valve 236 against the seat 234. The ball check valve chambers 222, 224, 226, 228, 230 and 232 communicate with an armature manifold chamber 240 respectively through passageways 242, 244, 246, 248, 250 and 252. Passageways 244, 248, and 252 are located, respectively, behind passageways 242, 246, and 250 and are therefore not visible in FIG. 5. An armature 254 is disposed in armature manifold chamber 240.

A hydraulic fluid passageway 256 communicates between the armature manifold chamber 240 and duct 258 which supplies hydraulic fluid to the pulse generator 85'. The solenoid coil is shown at 260 and the leads to the solenoid coil at 262, 264. A relatively stiff spring 266 is seated in a bore 268 formed in the solenoid core and normally biases the armature 254 away from the coil 260. Control rods 270 are disposed between the armature 254 and the ball check valves 236 in the passageways 242, 244, 246, 248, 250 and 252.

Master pistons 272, 274, 276, 278, 280 and 282 are located respectively in master cylinders 198, 200, 202, 204, 206 and 208 and are driven by ring 97 and eccentric 96 from drive shaft 86'. A duct 284 communicates between master cylinder 198 and a slave cylinder (not shown) associated with engine Cylinder No. 6. Ducts 286, 288, 290, 292, 294 communicate, respectively, with slave cylinders (not shown) associated, respectively, with engine Cylinder Nos. 2, 4, 1, 5 and 3. A pressure control mechanism 150 like that described in connection with FIGS. 4A and 4B may be located in each of the ducts 284, 286, 288, 290, 292 and 294. A circular cam 296 is positioned on the shaft 86' adjacent to the eccentric 96 and may either be keyed to the shaft 86' or freely rotatable with respect thereto. In either event, the cam 296 provides a limit for the inward travel of each of the master pistons 272, 274, 276, 278, 280 and 282.

The operation of the mechanism shown in FIG. 5 is as follows: when the solenoid coil 260 is deenergized (as shown in FIG. 5), the ball check valves 236 are held in the open position. As a consequence, the sequential movement of the pistons 272, 274, 276, 278, 280 and 282 in their respective cylinders 198, 200, 202, 204, 206 and 208 causes hydraulic fluid to circulate among the master cylinders via the passageways 210, 212, 214, 216, 218 and 220 and the armature manifold chamber 240 without any substantial pressure build-up in the ducts 284, 286, 288, 290, 292 and 294. The chamber 240 will be seen to function as a manifold with respect to the ducts 284, 286, 288, 290, 292 and 294 and the master cylinders respectively associated with those ducts. The system will remain full of hydraulic fluid since any leakage of fluid past the solid master pistons 272, 274, 276, 278, 280 and 282 into the eccentric chamber 104 will be made up from the supply duct 258. It will be understood that a drainage path (not shown) is provided from the eccentric chamber 104 to an hydraulic fluid sump (not shown).

However, when the solenoid coil 260 is energized, the armature 254 will be attracted to the coil 260 against the bias of the spring 268 thereby permitting the check valves 238 to seal against the seats 234. As the passageways 210, 212, 214, 216, 218 and 220 are closed, the sequential movement of the pistons 272, 274, 276, 278, 280 and 282 provides sequential pressure pulses in the respective ducts 284, 286, 288, 290, 292 and 294 which are timed to actuate slave pistons associated, respectively, with engine Cylinder Nos. 6, 2, 4, 1, 5 and 3. It will be appreciated that the precise timing of the pressure pulses depends upon the relative position of the drive shaft 86' and the eccentric 96. Since the shaft 86' is driven at half the speed of the engine, one rotation of shaft 86' will produce one pulse at each cylinder of the engine when that cylinder is near the end of its compression stroke. If it is desired to vary the timing of the pressure pulses as a function of the boost pressure, the cam 296 may be provided with six lobes similar in shape to the three lobes of cam 194 shown in FIGS. 4A and 4B. The position of the cam 296 may be controlled by a piston and linkage responsive to boost pressure as shown in FIGS. 4A and 4B. In this circumstance it will, of course, be necessary for the cam 296 to be freely rotatable with respect to the shaft 86'.

As noted above, the three element pulse mechanism shown in FIGS. 4A and 4B can provide one timed pulse to each of six engine cylinders near the beginning of the expansion stroke when the three element pulse mechanism is operated at engine speed. Similarly the six element pulse mechanism shown in FIG. 5 can provide one timed pulse to each of six engine cylinders near the beginning of the expansion stroke of each piston when the six element pulse mechanism is operated at half the speed of the engine. Although these two modes of operation represent preferred forms of the invention, a third mode of operation is also possible. The third mode, in the context of a six cylinder engine, involves operating a six element pulse mechanism at full engine speed. Such operation will produce a timed pulse to each of the six engine cylinders near the beginning of the expansion stroke of each piston and a second timed pulse to each of the six engine cylinders near the beginning of the intake stroke of each piston. As both the exhaust and intake valves are open at the beginning of the intake stroke of the piston, the second pulse performs no useful retarding function but it is not detrimental to the engine operation or to the retarding function.

Figure 7:
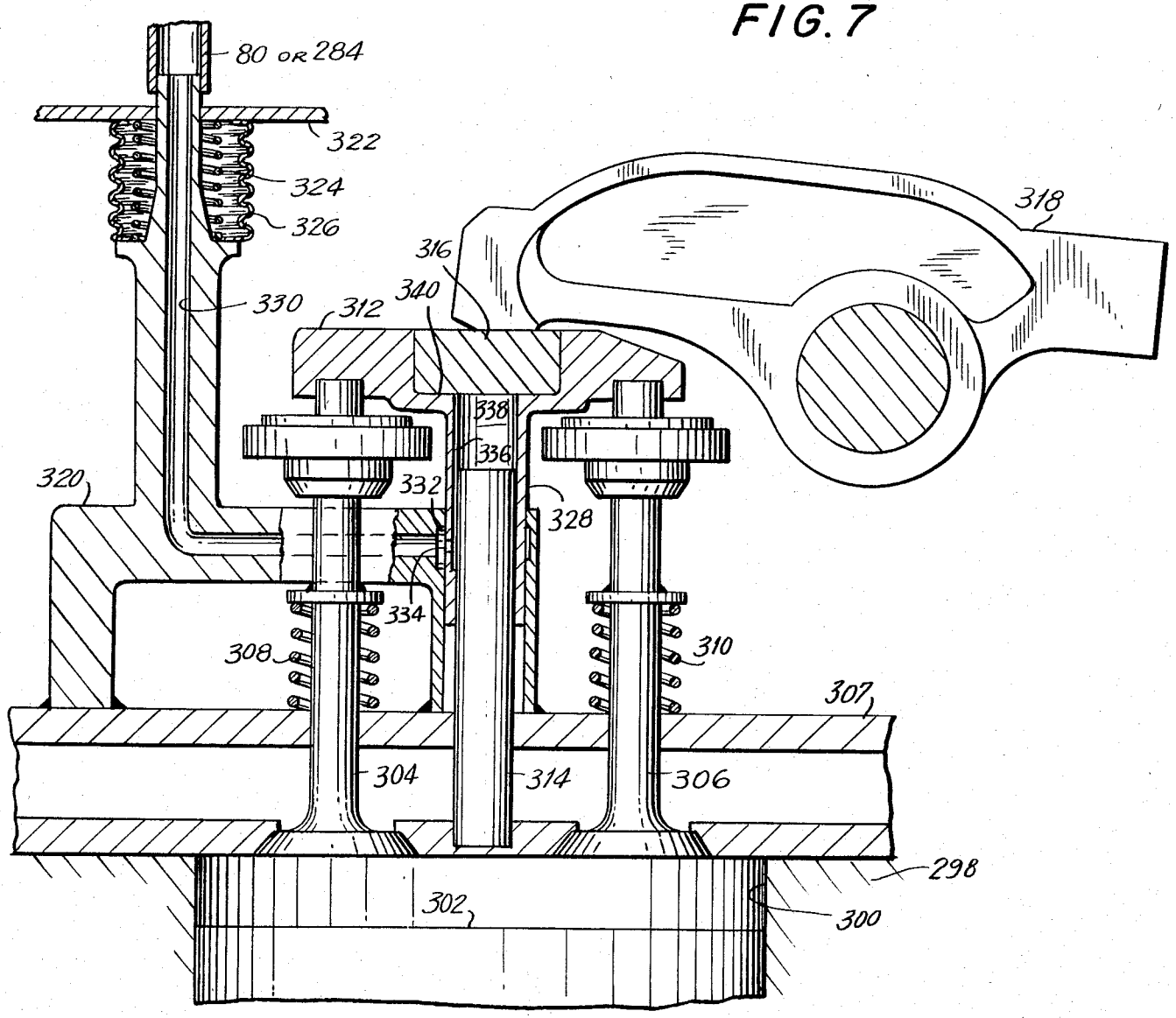
FIG. 7 is an enlarged side view, partly in section, of a modified exhaust valve crosshead incorporating an integral slave piston adapted to drive dual exhaust valves.

Reference is now made to FIG. 7 which shows a modified crosshead in accordance with the present invention for an engine employing two exhaust valves per cylinder. The engine block is shown at 298 and a cylinder at 300. A piston 302 reciprocates within the cylinder 300. Dual exhaust valves 304, 306 mounted in the engine head 307 are biased toward the closed position by valve springs 308, 310. A crosshead 312 journalled on a pin 314 affixed to the engine head 307 engages the exhaust valves 304, 306. In accordance with the present invention, a slave piston 316 is closely journalled into the central portion of the crosshead 312 where the crosshead is engaged by the exhaust valve rocker arm 318.

A housing 320 is affixed to the engine head 307 and sealed against the engine valve cover 322 by a spring 324 and a bellows seal 326. One end of the housing 320 is journalled to receive the shank 328 of the reciprocating crosshead 312. The housing 320 contains a passageway 330 which communicates with one of the ducts 80, 92 or 94 (FIGS. 3A–3F, and 4A–4B) or one of the ducts 284, 286, 288, 290, 292 and 294 (FIG. 5). The other end of the duct 330 terminates in an annular recess 332 which surrounds the shank 328 of the crosshead 312. At least one orifice 334 is formed in the shank 328 of the crosshead 312 so as to communicate between the annular recess 332 and a longitudinal groove 336 formed in the inner surface of the shank 328 of the crosshead 312.

In operation, hydraulic fluid under pressure passing through the passageway 330 sequentially flows through the annular recess 332, the orifice 334 and the longitudinal groove 336 to enter the cylindrical chamber 338. The chamber 338 is defined by the region within the shank 328 of the crosshead 312 between the slave piston 316 and the pin 314. As the pin 314 is fixed to the engine head 307 and the slave piston 316 is held in a fixed position by the rocker arm 318, the hydraulic fluid acts against the annular area 340 where the slave piston 316 contacts the crosshead 312 and drives the crosshead downwardly to open the valves 304, 306 against the bias of the valve springs 308, 310. When the compression release retarding system is not in operation, the normal motion of the crosshead 312 is determined by the rocker arm 318 and this motion will cause some of the hydraulic fluid contained in the chamber 338 to be circulated back through the ducts 330 and 80 or 284 to the pulse generator 85 or 85'.

Figure 8:
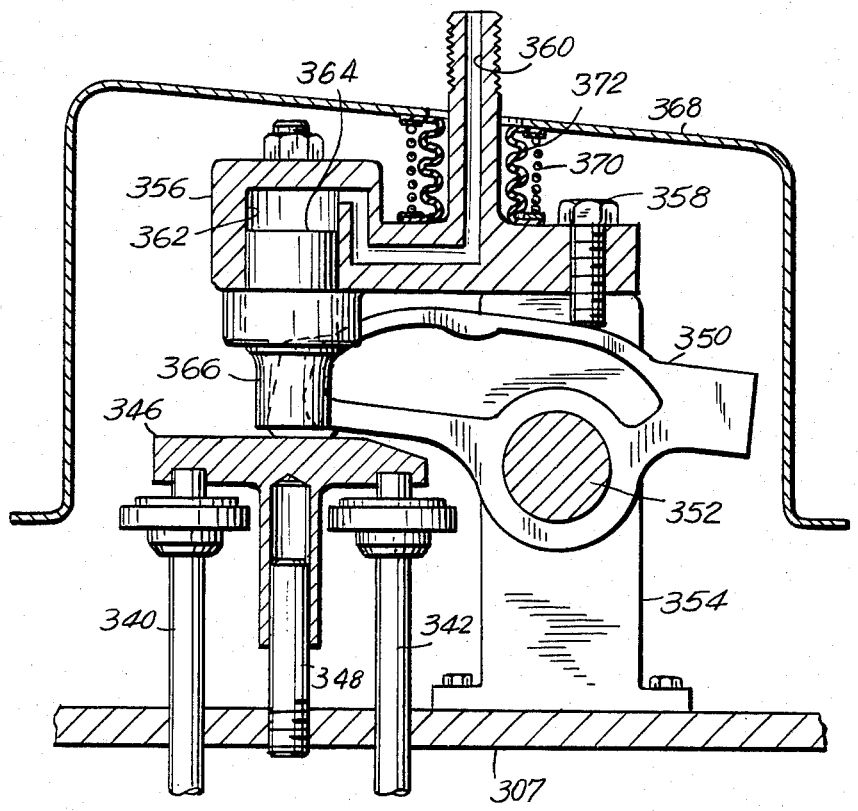
FIG. 8 is a side view, partly in section, of a slave piston actuated by an hydraulic pulse and arranged to drive an exhaust valve crosshead.

An alternative form of an exhaust valve actuator for use in the present invention is shown in FIG. 8. In this alternative, no modification is required for the exhaust valve crosshead. Exhaust valves 340, 342 are mounted in the engine head 307. The exhaust valve crosshead 346 is normally actuated by an exhaust valve rocker arm 350 pivoted on a shaft 352 mounted in a rocker arm frame 354 fastened to the engine head 307. In accordance with the present invention, a slave cylinder housing 356 is affixed to the rocker arm frame 354 by capscrews 358. A passageway 360 is formed in the housing 356 and communicates between the slave cylinder 362 and one of the ducts 80, 92 or 94 (FIGS. 3 and 4) or one of the ducts 284, 286, 288, 290 292 or 294 (FIG. 5). A slave piston 364 is mounted for reciprocating motion within the slave cylinder 362 and is provided with an extension 366 adapted to engage the crosshead 346 without interfering with the normal motion of the rocker arm 350. The slave cylinder housing 356 normally contains a return spring (not shown), functionally equivalent to the springs 65 or 78 in FIGS. 3A–3F, which biases the slave piston extension 366 away from crosshead 346. The slave cylinder housing 358 may be sealed against the valve cover 368 by a spring 370 and a bellows seal 372.

Figure 9:
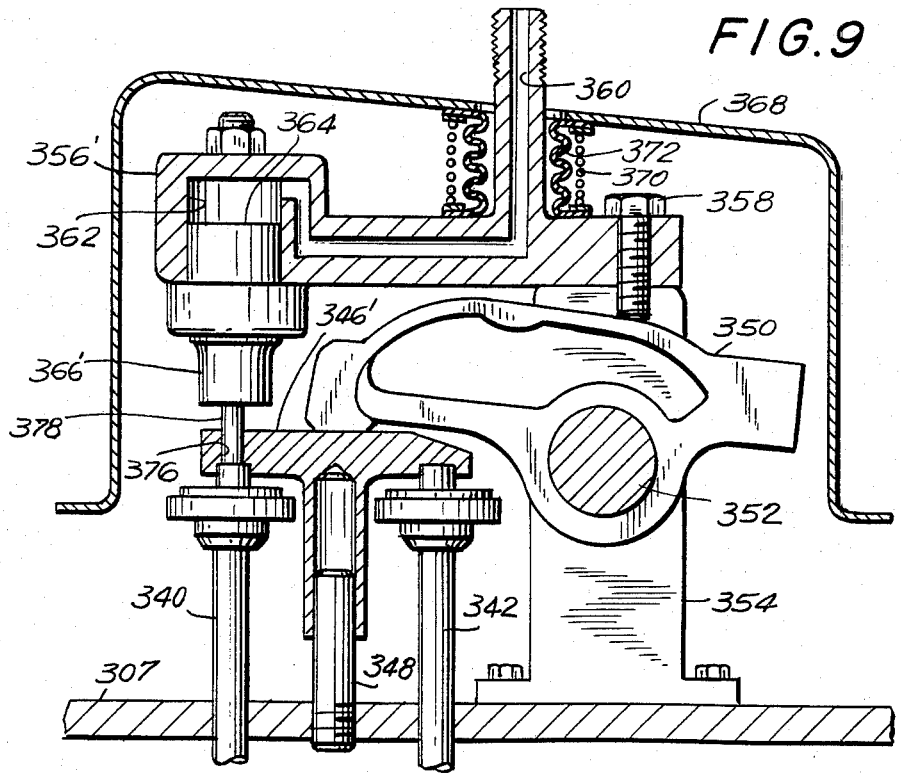
FIG. 9 is a side view, partly in section, of a modification of FIG. 8 in which only one of the dual exhaust valves is actuated by the slave piston.

FIG. 9 shows a modification of the structure illustrated in FIG. 8 wherein the slave piston actuates only one of the dual exhaust valves. Parts common to both FIGS. 8 and 9 are designated by the same numbers while modified parts are designated by a prime (′). In the FIG. 9 modification, the slave cylinder housing 356′ is lengthened so that the slave cylinder is substantially coaxial with exhaust valve 340. A bore 376 is formed in the crosshead 346′ and pin 378 is freely journalled in the bore 376. The pin 378 extends between the end of the exhaust valve 340 and the slave piston extension 366′. It will be understood that the rocker arm 350 acts upon the crosshead 346′ and opens both exhaust valves 340 and 342 during a normal engine fueling operation. However, during an engine retarding operation, the slave postion 364, acting through the pin 378 opens only exhaust valve 340. One advantage of the single valve operation is that lower hydraulic pressures are produced in the compression release mechanism. This, in turn, reduces the elastic deformation in the system.

Figure 10:
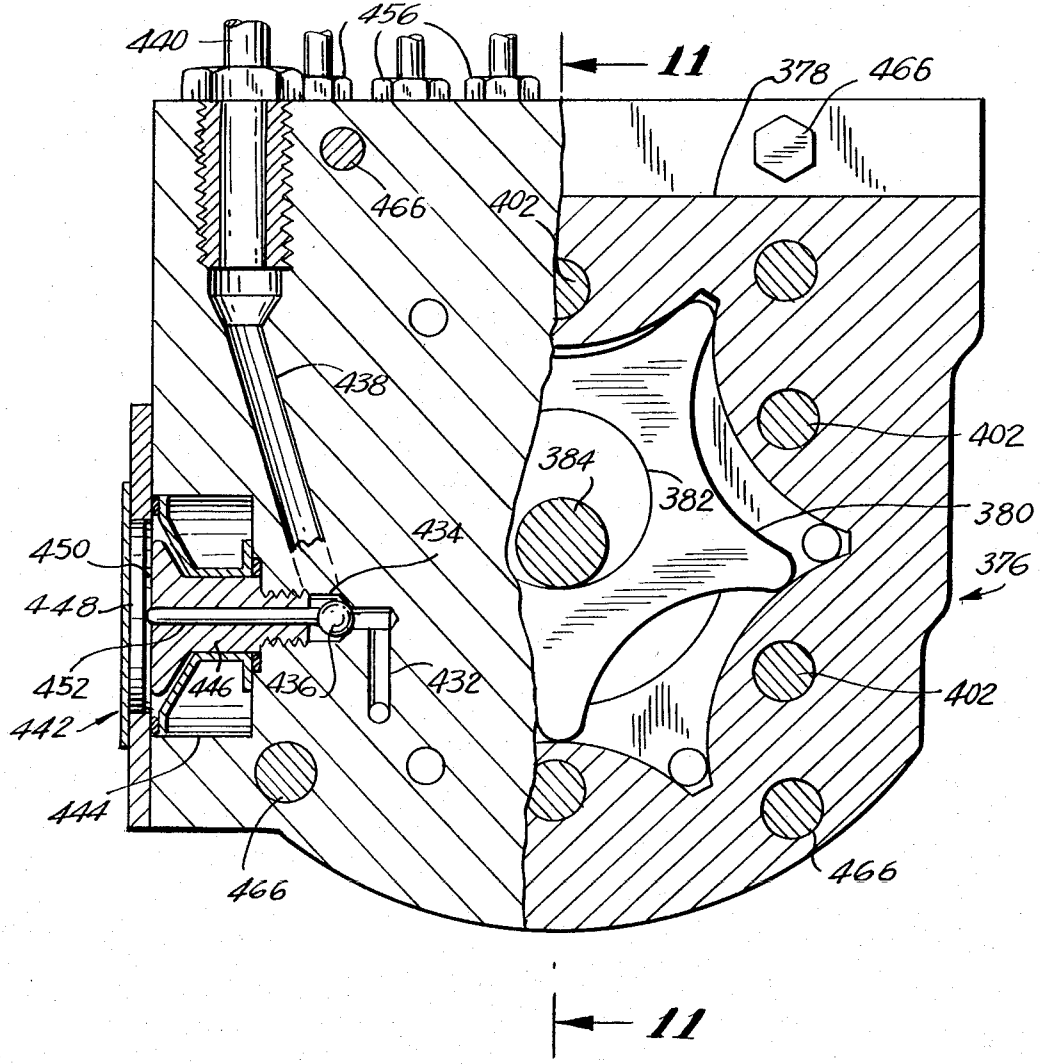
FIG. 10 is an end view, partly in section and broken away of an alternative pulse generator employing a positive displacement gear pump.
Figure 11:
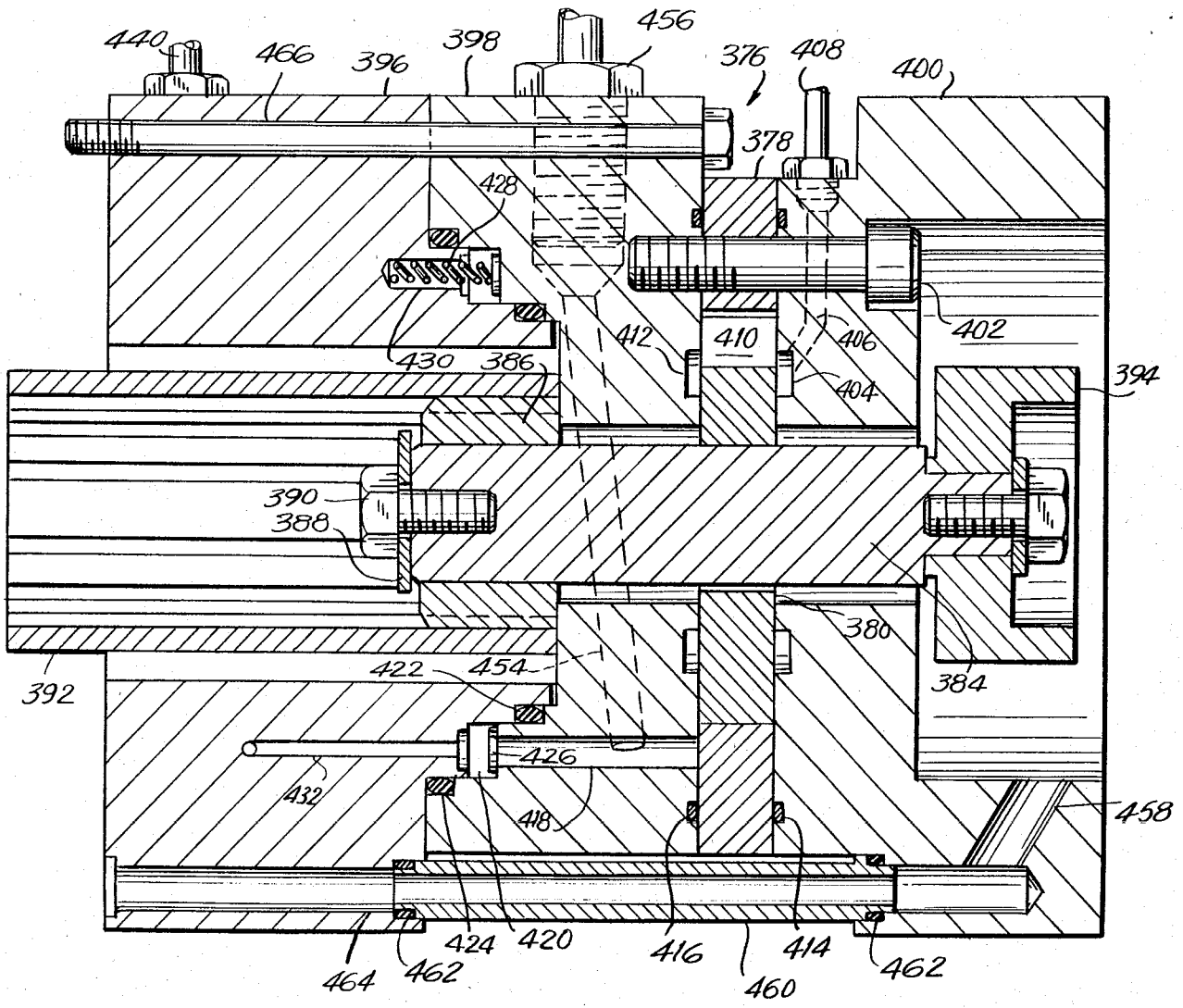
FIG. 11 is a cross sectional view taken along lines 11—11 of FIG. 10.

Reference is now made to FIGS. 10 and 11 which illustrate an alternative pulse generator 376 employing a positive displacement gear pump. As applied to an engine having six cylinders, the pulse generator 376 comprises an internal gear element 378 having six teeth and designed to mesh with an eccentrically mounted five toothed gear 380. The gear 380 is journalled on an eccentric 382 keyed to a shaft 384, preferably, positively driven at half the speed of the engine. More specifically, a spline ring 386 (FIG. 11) is keyed to the shaft 384 and locked to the shaft by a washer 388 and a capscrew 390. The spline ring 386 mates with internal splines formed on an auxiliary drive shaft 392 positively driven at half the speed of the engine crankshaft. In the event that other accessories are also to be driven from the auxiliary drive shaft 392, a second spline ring 394 may be affixed on the opposite end of shaft 384.

The body of the pulse generator comprises an adapter plate 396 and a main housing 398 affixed to the engine block (not shown) by capscrews 466 and a rear housing 400. The rear housing 400, internal gear element 378 and main housing 398 are fixed together by six capscrews 402 positioned intermediate the roots of the six lobes or teeth of the internal gear 378. An annular groove 404 is formed in the rear housing 400 which groove communicates through a passageway 406 to an hydraulic fluid supply duct 408. The annular groove 404 is smaller in maximum diameter than a circle tangent to the lobes of the internal gear 378 so that as the external gear 380 rotates within the internal gear 378, it sweeps across the annular groove 404 and traps hydraulic fluid in the chamber defined by the teeth of the gears 378, 380 and the surfaces of the housings 398, 400. It will be understood that the diameter of the annular groove 404 defines the volume of the chamber 410 and the point at which the hydraulic fluid may be pressurized. Thus, the diameter of the annular groove 404 defines the position of the line 32 in the schematic diagram of FIG. 2A. An annular groove 412 equal in size to the groove 404 is formed in the housing 398. O-rings 414, 418 may be positioned between the internal gear 378 and the housings 400, 398 to inhibit leakage of hydraulic fluid.

Passageways 418 are formed in housing 398 adjacent the root portion of each of the six teeth of the internal gear 378. The passageways 418 communicate with an annular chamber 420 formed between the main housing 398 and the adapter plate 398 which functions as a manifold with respect to the passageways 418 and the several chambers 410 of the positive displacement gear pump. The annular manifold chamber 420 may conveniently be sealed by the use of O-rings 422 and 424 located between the adapter plate 396 and the main housing 398. An annular ring valve 426 is freely positioned in the annular chamber 420 and biased toward the housing 398 by a plurality of springs 428 seated in blind holes 430 formed in the adapter plate 396.

A passageway 432 communicates between the annular chamber 420 and a ball valve chamber 434 (FIG. 10) containing a ball valve 436. Passageway 438 connects the ball valve chamber 434 and a supply line 440. A solenoid 442 is mounted in the adapter plate 396 and comprises a solenoid coil 444, a core 446, a disc type armature 448 loosely fitted in an armature chamber 450 and a pin 452 positioned in the core 446 between the armature 448 and the ball valve 436.

When the solenoid coil 444 is energized, the armature 448 drives the pin 452 against the ball valve 436 to prevent the flow of hydraulic fluid from the passageway 432 to the passageway 438 and thence to the supply line 440.

Also communicating with each passageway 418 is an outlet duct 454 which leads to a fitting 456 in the main housing 398. The fittings 456 are adapted to receive, respectively, ducts 284, 286, 288, 290, 292 and 294 (FIG. 5) which ducts are connected to slave cylinders associated respectively, with Cylinder Nos. 6, 2, 4, 1, 5 and 3 of the engine.

A passageway 458 formed at the bottom of the housing 400 communicates with a tube 460 and a passageway 464 formed in the adapter plate 396. The tube 460 may conveniently be sealed into the housing 400 and adapter plate 396 by O-rings 462.

In operation, it will be understood that rotation of the auxiliary drive shaft 392 will drive the shaft 384 and the eccentric 382 so as to rotate the five toothed external gear 380 within the six toothed internal gear 378. Pulses of hydraulic fluid will be delivered sequentially from each of the chambers 410 through the passageways 418 and into the annular chamber 420. Some of the hydraulic fluid will be circulated between the chambers 410 through the passageways 418 and the annular manifold chamber 420 while a portion of the hydraulic fluid will pass through the passageways 432 and 438 to the supply line 440. Fluid which may leak out of the chambers 410 and along shaft 384 will fall into the passageway 458 and be returned to the engine hydraulic fluid sump through tube 460 and passageway 464. Because the passageway 432 is open, it is not possible to develop any significant pressure in the outlet ducts 454.

However, when the solenoid 442 is energized, the ball valve 436 will seal the passageway 432 and allow a build-up of pressure in the annular manifold chamber 420. Such pressure will cause the ring valve 426 to seal against the passageways 418 that are under low pressure so that the pulse of hydraulic fluid from one chamber 410 will pressurize one passageway 418, one outlet duct 454 and be delivered to one of the ducts 284, 286, 288, 290, 292 or 294 and its associated slave cylinder. It will be understood that continued rotation of the auxiliary drive shaft 392 will result in sequential pulses of hydraulic fluid in each of the ducts 284, 286, 288, 290, 292 and 294 and their associated slave cylinders. As the shaft 392 rotates at half the speed of the engine crankshaft it will be appreciated that during the course of two revolutions of the engine crankshaft one hydraulic pulse will be delivered to each of the ducts 284, 286, 288, 290, 292 and 294 and its associated slave cylinder. By an appropriate adjustment of the spline ring 386 relative to the auxiliary drive shaft 392, the pulses may be timed so that each engine exhaust valve is opened at a predetermined time close to the T.D.C. position of the engine piston at the end of the compression stroke of the cylinder with which the exhaust valve is associated.

Although, as noted above, it is preferable to drive the gear pump mechanism of FIGS. 10 and 11 having six impulse chambers at half engine speed, it is also possible to drive the gear pump at full engine speed. When the gear pump is operated at full engine speed, half of the impulses will occur near the beginning of the intake stroke of each engine piston and will neither provide a useful retarding function nor any action detrimental to the engine.

While the above description has been based upon the assumption of the use of a six-cylinder engine, it will be understood that the pulse generator shown in FIGS. 10 and 11 may be modified so as to be applicable to engines having any number of cylinders by providing an internal gear 378 having the same number of teeth as the engine has cylinders and an external gear 380 having one tooth less than the number of cylinders in the engine.

The pulse generator of FIGS. 10 and 11 contains a chamber 410 for each engine cylinder. If desired, only three of the chambers need be used in accordance with the slave cylinder arrangement shown in FIG. 3. In this event, the outlets 456 of the remaining chambers 410 may be directed back to the supply line 408 or 440 or the output of the remaining chambers 410 may be used for another purpose. Of course, the pulse generator of FIGS. 10 and 11 may also be designed with one chamber 410 for each pair of engine cylinders. Similarly, the pulse generator of FIG. 5 may be modified to provide one master piston for each pair of cylinders of an engine while the pulse generator of FIGS. 3 and 9 may be modified to provide a master piston for each engine cylinder.

While neither a pressure control mechanism nor a boost pressure timing mechanism has been shown specifically in FIGS. 10 and 11 it will be apparent to those skilled in the art that either or both mechanisms can be used in the embodiment of FIGS. 10 and 11. A pressure control mechanism 150 as shown in FIGS. 4A and 4B may be placed in the ducts 80, 92 or 94 or the ducts 284, 286, 288, 290, 292 or 294 which communicate between the outlets 456 and the slave cylinders. In order to incorporate a boost pressure timing mechanism into the embodiment of FIGS. 10 and 11 it is necessary to provide for oscillation of the internal gear 378 with respect to the drive shaft 384. This may be accomplished by re-forming the holes for the capscrews 402 as arcuate slots and providing an hydraulic cylinder 184, 190 and linkage 198 as shown in FIGS. 4A and 4B to oscillate the gear 378 in response to variations in intake manifold boost pressure.

The terms and expressions which have been employed are used as terms of description and not of limitation and there is no intention in the use of such terms and expressions of excluding any equivalent of the features shown and described or portions thereof, but it is recognized that various modifications are possible within the scope of the invention claimed.

What is claimed is:

1. A compression release engine retarder for use in a multi-cylinder four cycle internal combustion engine having a crankshaft, intake and exhaust manifolds, intake valves, and at least one exhaust valve for each cylinder comprising a rotary hydraulic pulse generator positively driven in synchronism with said engine crankshaft, at least one slave piston operatively communicating with an exhaust valve and adapted to open said exhaust valve near the beginning of the expansion stroke of the engine cylinder with which said exhaust valve is associated when actuated by an hydraulic pulse produced by said pulse generator, duct means communicating between each said slave piston and said pulse generator to deliver said hydraulic pulse from said pulse generator to said slave piston, means to supply hydraulic fluid to said pulse generator, control valve means communicating with each said duct means and pressure control means communicating with said duct means, said pressure control means comprising a cylinder communicating with said duct means, a piston mounted within said cylinder for reciprocating motion therewith and spring means biasing said piston against the hydraulic fluid pressure in said cylinder and duct means.

2. A compression release engine retarder for use in a multi-cylinder four cycle internal combustion engine having a crankshaft, intake and exhaust manifolds, intake valves, and at least one exhaust valve for each cylinder comprising a rotary hydraulic pulse generator positively driven in synchronism with said engine crankshaft, at least one slave piston operatively communicating with an exhaust valve and adapted to open said exhaust valve near the beginning of the expansion stroke of the engine cylinder with which said exhaust valve is associated when actuated by an hydraulic pulse produced by said rotary hydraulic pulse generator, duct means communicating between each said slave piston and said pulse generator to deliver said hydraulic pulse from said pulse generator to said slave piston, means to supply hydraulic fluid to said pulse generator, control valve means communicating with each said duct means and pressure control means communicating with said duct means, said pressure control means comprising a Bourdon tube.

3. A compression release engine retarder for use in a multi-cylinder four cycle internal combustion engine having a crankshaft, intake and exhaust manifolds, intake valves, and at least one exhaust valve for each cylinder comprising a rotary hydraulic pulse generator positively driven in synchronism with said engine crankshaft at engine speed, said pulse generator having one positive displacement pump element for each pair of engine cylinders having pistons which reach top dead center of the engine simultaneously, at least one slave piston operatively communicating with an exhaust valve and adapted to open said exhaust valve near the beginning of the expansion stroke of the engine cylinder with which said exhaust valve is associated when actuated by an hydraulic pulse produced by said pulse generator, duct means communicating between each said slave piston and said pulse generator to deliver said hydraulic pulse from said pulse generator to said slave piston, said duct means interconnecting said positive displacement pump element and said slave piston operatively communicating with said exhaust valve associated with said pair of engine cylinders, means to supply hydraulic fluid to said pulse generator and control valve means communicating with each said duct means.

4. Apparatus as described in claim 3 in which the positive displacement pump elements each comprise a first piston reciprocable between first and second positions within a first cylinder and wherein the said first position of said first piston is adjustable by pressure adjusting means responsive to the pressure existing in said inlet manifold of said engine, said pressure adjusting means comprising a rotary cam cooperating with said first piston to define the said first position of said first piston, a second cylinder communicating with said inlet manifold through a second duct, a second piston reciprocably moveable within said second cylinder in response to the pressure in said second cylinder and said inlet manifold, a spring in said second cylinder biasing said second piston against the pressure in said second cylinder and a link interconnecting said second piston and said rotary cam.

5. Apparatus as described in claim 3 wherein the control valve means comprises a disc valve moveable in a manifold between first and second positions and a solenoid actuated check valve communicating with said manifold, said manifold interconnecting each said duct means, said disc valve in its said first position preventing interconnection of each said duct means but in its said second position permitting interconnection of each said duct means through said manifold.

6. A compression release engine retarder for use in a multi-cylinder four cycle internal combustion engine having a crankshaft, intake and exhaust manifolds, intake valves, and at least one exhaust valve for each cylinder comprising a rotary hydraulic pulse generator positively driven in synchronism with said engine crankshaft at half the engine speed, said pulse generator having one positive displacement pump element for each engine cylinder, at least one slave piston operatively communicating with an exhaust valve and adapted to open said exhaust valve near the beginning of the expansion stroke of the engine cylinder with which said exhaust valve is associated when actuated by an hydraulic pulse produced by said pulse generator, duct means communicating between each said slave piston and said pulse generator to deliver said hydraulic pulse from said pulse generator to said slave piston, said duct means interconnecting each said positive displacement pump element and the slave piston operatively communicating with the exhaust valve associated with each said engine cylinder, means to supply hydraulic fluid to said pulse generator and control valve means communicating with each said duct means.

7. Apparatus as described in claim 6 in which the positive displacement pump elements each comprise a first piston reciprocable between first and second positions within a first cylinder and wherein the said first position of said first piston is adjustable by pressure adjusting means responsive to the pressure existing in said inlet manifold of said engine, said pressure adjusting means comprising a rotary cam cooperating with said first piston to define the said first position of said first piston, a second cylinder communicating with said inlet manifold through a second duct, a second piston reciprocably moveable within said second cylinder in response to the pressure in said second cylinder and said inlet manifold, a spring in said second cylinder biasing said second piston against the pressure in said second cylinder and a link interconnecting said second piston and said rotary cam.

8. Apparatus as described in claim 6 wherein the control valve comprises a disc valve moveable in a manifold between first and second positions and solenoid actuated check valves communicating with said manifold, said manifold interconnecting each said duct means, said disc valve in its said first position preventing interconnection of each said duct means but in its said second position permitting interconnection of each said duct means through said manifold.

9. A compression release engine retarder for use in a multi-cylinder internal combustion engine having a crankshaft, intake and exhaust manifolds, intake valves, and at least one exhaust valve for each cylinder comprising a rotary hydraulic pulse generator positively driven in synchronism with said engine crankshaft at the engine speed, said pulse generator having one positive displacement pump element for each engine cylinder, at least one slave piston operatively communicating with an exhaust valve and adapted to open said exhaust valve near the beginning of the expansion stroke of the engine cylinder with which said exhaust valve is associated when actuated by an hydraulic pulse produced by said pulse generator, duct means communicating between each said slave piston and said pulse generator to deliver said hydraulic pulse from said pulse generator to said slave piston, said duct means interconnecting each said positive displacement pump element and the slave piston operatively communicating with the exhaust valve associated with each said engine cylinder, means to supply hydraulic fluid to said pulse generator and control valve means communicating with each said duct means.

10. Apparatus as described in claim 9 in which the positive displacement pump elements each comprise a first piston reciprocable between first and second positions within a first cylinder and wherein the said first position of said first piston is adjustable by pressure adjusting means responsive to the pressure existing in said inlet manifold of said engine, said pressure adjusting means comprising a rotary cam cooperating with said first piston to define the said first position of said first piston, a second cylinder communicating with said inlet manifold through a second duct, a second piston reciprocably moveable within said second cylinder in response to the pressure in said second cylinder and said inlet manifold, a spring in said second cylinder biasing said second piston against the pressure in said second cylinder and a link interconnecting said second piston and said rotary cam.

11. Apparatus as described in claim 9 in which the control valve comprises a disc valve moveable in a manifold between first and second positions and solenoid actuated check valves communicating with said manifold, said manifold interconnecting each said duct means, said disc valve in its said first position preventing interconnection of each said duct means but in its said second position permitting interconnection of each said duct means through said manifold.

12. A compression release engine retarder for use in a multi-cylinder, four cycle internal combustion engine having a crankshaft, intake and exhaust manifolds, intake valves, and at least one exhaust valve for each cylinder comprising a rotary hydraulic pulse generator positively driven in synchronism with said engine crankshaft at half the engine speed, said pulse generator comprising a positive displacement pump having an internal gear having a number of teeth or lobes equal to the number of cylinders in the said multi-cylinder engine which meshes with an external gear having one less tooth than the said internal gear so as to define a number of positive displacement pump chambers equal to the number of cylinders in said multicylinder engine, at least one slave piston operatively communicating with an exhaust valve and adapted to open said exhaust valve near the beginning of the expansion stroke of the engine cylinder with which said exhaust valve is associated when actuated by an hydraulic pulse produced by said pulse generator, duct means communicating between each said slave piston and said pulse generator to deliver said hydraulic pulse from said pulse generator to said slave piston, said duct means interconnecting each said positive displacement pump chamber and the slave piston operatively communicating with the exhaust valve associated with each said engine cylinder, means to supply hydraulic fluid to said pulse generator and control valve means communicating with each said duct means.

13. Apparatus as described in claim 12 wherein the control valve comprises a ring valve moveable in a manifold between first and second positions and a solenoid actuated check valve communicating with said manifold, said manifold interconnecting each said duct means, said ring valve in its said first position preventing interconnection of each said duct means but in its said second position permitting interconnection of each said duct means through said manifold.

14. A compression release engine retarder for use in a multi-cylinder, four cycle internal combustion engine having a crankshaft, intake and exhaust manifolds, intake valves, and at least one exhaust valve for each cylinder comprising a rotary hydraulic pulse generator positively driven in synchronism with said engine crankshaft at the engine speed, said pulse generator comprising a positive displacement pump having an internal gear having a number of teeth or lobes equal to the number of cylinders in the said multi-cylinder engine which meshes with an external gear having one less tooth than the said internal gear so as to define a number of positive displacement pump chambers equal to the number of cylinders in said multicycle engine, at least one slave piston operatively communicating with an exhaust valve and adapted to open said exhaust valve near the beginning of the expansion stroke of the engine cylinder with which said exhaust valve is associated when actuated by an hydraulic pulse produced by said pulse generator, duct means communicating between each said slave piston and said pulse generator to deliver said hydraulic pulse from said pulse generator to said slave piston, said duct means interconnecting each said positive displacement pump chamber and the slave piston operatively communicating with the exhaust valve associated with each said engine cylinder, means to supply hydraulic fluid to said pulse generator and control valve means communicating with each said duct means.

15. Apparatus as described in claim 14 wherein the control valve comprises a ring valve moveable in a manifold between first and second positions and a solenoid actuated chick valve communicating with said manifold, said manifold interconnecting each said duct means, said ring valve in its said first position preventing interconnection of each said duct means but in its said second position permitting interconnection of each said duct means through said manifold.

* * * * *